US008210898B2

(12) United States Patent
Johnson

(10) Patent No.: US 8,210,898 B2
(45) Date of Patent: Jul. 3, 2012

(54) PIVOTALLY MANIPULABLE TOY

(75) Inventor: Dennis E. Johnson, Oostburg, WI (US)

(73) Assignee: Parchmint, Inc., Mequon, WI (US)

( * ) Notice: Subject to any disclaimer, the term of this patent is extended or adjusted under 35 U.S.C. 154(b) by 82 days.

(21) Appl. No.: 12/543,169

(22) Filed: Aug. 18, 2009

(65) Prior Publication Data

US 2010/0210176 A1 Aug. 19, 2010

Related U.S. Application Data

(60) Provisional application No. 61/153,152, filed on Feb. 17, 2009.

(51) Int. Cl.
*A63H 33/00* (2006.01)

(52) U.S. Cl. ..... 446/487; 446/104; 446/113; 434/160; 434/193

(58) Field of Classification Search ..... 446/487, 446/113, 104, 111; 428/53; 434/159–161, 434/205, 171–176; D21/468; *G09B 1/00; G09B 19/00*

See application file for complete search history.

(56) References Cited

U.S. PATENT DOCUMENTS

| | | | | | |
|---|---|---|---|---|---|
| 207,346 | A * | 8/1878 | Clow | 446/114 |
| 1,452,340 | A * | 4/1923 | Hubbar | 434/160 |
| 1,541,004 | A * | 6/1925 | Taylor | 434/160 |
| 1,854,999 | A * | 4/1932 | Ralls | 434/205 |
| 1,860,627 | A * | 5/1932 | Sherman | 446/113 |
| 2,496,810 | A * | 2/1950 | Nerrie | 434/160 |
| D169,878 | S * | 6/1953 | Washington | D21/468 |
| 3,315,376 | A * | 4/1967 | Nielsen | 434/160 |
| 3,381,394 | A * | 5/1968 | Munro | 434/193 |
| 3,837,096 | A * | 9/1974 | Sterling | 434/200 |
| 3,977,683 | A | 8/1976 | Tomura | |
| 4,114,307 | A * | 9/1978 | Liebeskind | 446/487 |
| 4,382,794 | A * | 5/1983 | Preus | 434/193 |
| 4,605,383 | A | 8/1986 | Horiuchi | |
| 4,791,740 | A | 12/1988 | Ferrari | |
| 5,304,086 | A * | 4/1994 | Bolli et al. | 446/108 |
| 5,951,299 | A * | 9/1999 | Kim | 434/188 |
| 6,135,851 | A * | 10/2000 | Drake et al. | 446/487 |
| 2003/0162153 | A1 * | 8/2003 | Mohn et al. | 434/162 |

* cited by examiner

*Primary Examiner* — Gene Kim
*Assistant Examiner* — Matthew B Stanczak
(74) *Attorney, Agent, or Firm* — Andrus, Sceales, Starke & Sawall, LLP

(57) ABSTRACT

A pivotally manipulable toy is disclosed which includes a plurality of sections pivotally coupled in series, with a plurality of counting apertures being located in a plurality of the sections. The pivotally manipulable toy can be manipulated to form a plurality of shapes including letters and numbers. The pivotally manipulable toy may be used in a manner that is both educational and enjoyable for children. Further, a manual which correlates each of the shapes with the number of unobstructed counting apertures that are visible when each shape is formed correctly may be provided together with the pivotally manipulable toy.

9 Claims, 8 Drawing Sheets

PIVOTALLY MANIPULABLE TOY

CROSS-REFERENCE TO RELATED APPLICATION

This application claims priority of U.S. Provisional Patent Application No. 61/153,152, which is entitled "Pivotally Manipulable Toy," and which was filed on Feb. 17, 2009, the entirety of which application is hereby incorporated herein by reference.

BACKGROUND OF THE INVENTION

Field of the Invention—The present invention relates generally to a pivotally manipulable toy, and more particularly to a multi-segment pivotally manipulable toy with apertures in a number of the segments to facilitate aiding a user to configure the toy into any of a plurality of shapes each exposing a stated number of apertures.

In the past it has frequently been difficult to teach children in a manner that is both enjoyable and educational for the children. Teaching children the letters of the alphabet and numbers in an enjoyable manner has been the goal of many toy manufacturers for some time. Past toys that could be formed into the letters of the alphabet or numbers have often had multiple parts that could easily be lost. Such toys have also typically been difficult to manipulate correctly to form the letters or numbers. Many of these toys have been complicated and so difficult to manipulate as to frustrate the child, with many children being unsure as to whether they had manipulated the toy properly to correctly form the desired letters or numbers. These toys also often have a plethora of links or sections which have made it nearly impossible for a young child who is beginning to learn the alphabet and to count to form letters or numbers correctly.

Therefore, it is desirable to provide a pivotally manipulable toy that is educational, fun, and easy enough for a child as young as approximately two years of age to manipulate. It is also desirable that such a toy does not have multiple separate pieces that could tend to easily be lost. It is also desirable to provide a toy that has a verification system enabling a child using the toy to be certain as to whether or not the toy has been manipulated correctly to form a letter or numeral. It is also desirable to provide a toy that can be formed into many different shapes in addition to letters and numbers. It is further desirable to provide a manual that illustrates the toy in many different configurations forming many different shapes correctly.

Such a toy should also be of a construction which is both durable and long lasting, and it should also require little or no maintenance or special handling to be provided by the user throughout its operating lifetime. In order to enhance the market appeal of such a toy, it should also be of relatively inexpensive construction to thereby afford it the broadest possible market. Finally, it is also an objective that all of the aforesaid advantages and objectives of such a toy be achieved without incurring any substantial relative disadvantage.

SUMMARY OF THE INVENTION

An embodiment of the pivotally manipulable toy of the present invention includes a first solid end section having a first end and a second end, a plurality of intermediate sections each having a first end and a second end, and a second solid end section having a first end and a second end. One of the intermediate sections is pivotally coupled at its second end to the first solid end section near its second end. This intermediate section is then pivotally coupled near its first end to another of the intermediate sections near its second end. All but one of the remainder of the intermediate sections are pivotally coupled near the first end thereof to another of the intermediate sections near its second end thereof.

The final intermediate section is pivotally coupled near its first end to the second solid end section near its second end. This final intermediate section is also pivotally coupled near its second end to the only intermediate section remaining with a second end still uncoupled, near the second end of the remaining uncoupled intermediate section. The sections are all configured to form a consecutive plurality of sections such that each end of each section is coupled to no more than one other intermediate or solid end section. The first ends of each of the solid end sections remain uncoupled. A user can pivotally manipulate the toy to form a plurality of shapes.

Another embodiment of the present invention comprises a first solid end section having a first end and a second end, five intermediate sections, each having opposite first and second ends, with each of these intermediate sections containing several counting apertures, and a second solid end section having a first end and second end. The first solid end section is pivotally coupled near its second end to the first intermediate section near its second end. The first intermediate section is coupled near its first end to the second intermediate section near its second end. The second intermediate section is coupled near its first end to the third intermediate section near its second end. The third intermediate section is coupled near its first end to the fourth intermediate section near its second end. The fourth intermediate section is coupled near its first end to the fifth intermediate section near its second end. The fifth intermediate section is coupled near its first end to the second solid end section near its second end. The first ends of each of the solid end sections remain uncoupled. A user can pivotally manipulate the toy to form many shapes.

Another embodiment of the present invention comprises a method of producing a pivotally manipulable toy comprising providing a first solid end second having a first end and a second end, providing several intermediate sections each containing more than one counting aperture, and each having a first end and a second end, providing a second solid end section having a first end and a second end, forming a consecutive plurality of intermediate sections by pivotally coupling the intermediate sections end to end, and pivotally coupling each of the end sections to an opposite end of the consecutive plurality of intermediate sections. The first ends of each of the solid end sections remain uncoupled. The toy is formed such that a user can pivotally manipulate it to form more than one shape.

It may therefore be seen that the present invention teaches a pivotally manipulable toy that is educational, fun, and easy enough for a child as young as approximately two years of age to manipulate. It does not have multiple separate pieces that could tend to easily be lost, and it has a verification system that enables a child using the toy to be certain as to whether or not the toy has been manipulated correctly to form a letter or numeral. The pivotally manipulable toy of the present invention is a toy that can be formed into many different shapes in addition to letters and numbers. it also may include a manual that illustrates the toy in many different configurations forming many different shapes correctly. The manual further comprises instructions for playing a plurality of games with the toy.

The pivotally manipulable toy of the present invention is of a construction which is both durable and long lasting, and it should also require little or no maintenance to be provided by the user throughout its operating lifetime. The pivotally manipulable toy of the present invention is also be of relatively inexpensive construction to enhance its market appeal and to thereby afford it the broadest possible market. Finally, the pivotally manipulable toy of the present invention achieves all of the aforesaid advantages and objectives without incurring any substantial relative disadvantage.

DESCRIPTION OF THE DRAWINGS

These and other advantages of the present invention are best understood with reference to the drawings, in which.

DETAILED DESCRIPTION OF THE EXEMPLARY EMBODIMENTS

A pivotally manipulable toy 100 an example of which is illustrated in the figures is an educational, fun, pivotally adjustable mechanism. The pivotally manipulable toy 100 is configured so that it can be pivotally manipulated to form all the letters of the alphabet, the Arabic numerals 0-9, and various shapes.

The word "shapes" throughout this Application is understood to mean, for example, letters of the alphabet, numbers, geometric shapes (including, but not limited to, squares, rectangles, kites, triangles and other polygons), houses, fences, house lots, houses with chimneys, decks, porches, garages, car ports, cranes, forklifts, jack in the boxes, windmills, fans, bridges, backhoes, caterpillars, snails, ducks, giraffes, ostriches, wiener dogs, and many other shapes and objects that would become apparent to one pivotally manipulating the pivotally manipulable toy 100.

An embodiment of the pivotally manipulable toy 100 can be any color, could be multi-colored, could be colored in any number of designs or patterns, or could simply be the color of the material used to make the pivotally manipulable toy 100.

Because of the pivotally manipulable toy's 100 unique combination of solid sections and sections with apertures, which will be further discussed below, with each object that is formed there are a specific number of apertures that are unobstructed by a solid section or another piece with apertures.

A pivotally manipulable toy manual is also preferably provided. Such a manual may illustrate the way that shapes look when they are formed with the pivotally manipulable toy 100, and the manual correlates each of these shapes with the number of apertures that should be unobstructed when the pivotally manipulable toy 100 has been properly pivotally manipulated to form the object. The pivotally manipulable toy manual may also provide directions for playing a series of educational games with the pivotally manipulable toy 100, including games that involve counting, forming letters of the alphabet, and forming words.

Figure 1:
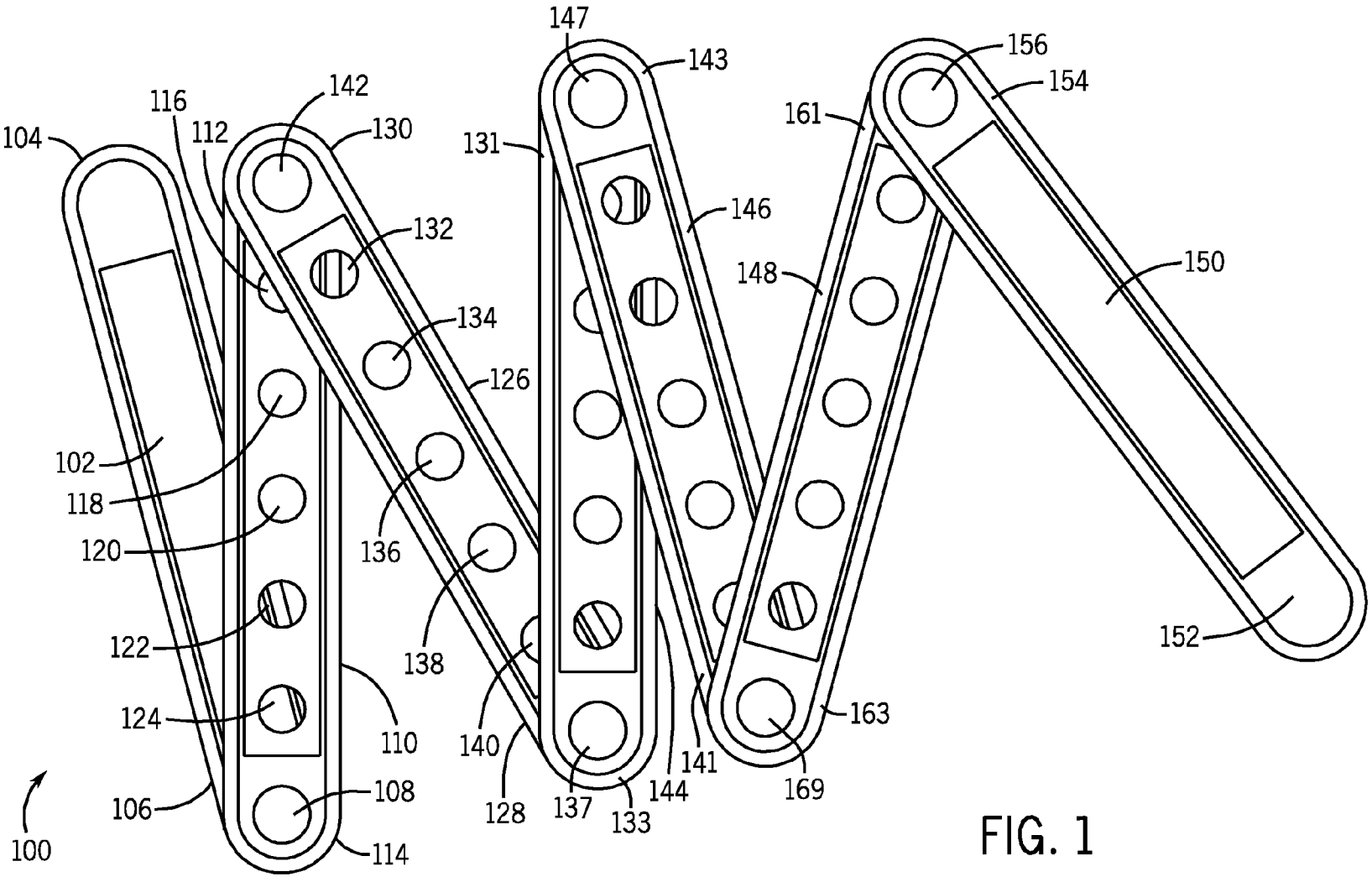
FIG. 1 is a plan view of a pivotally manipulable toy in a partially unfolded configuration.
Figure 2:
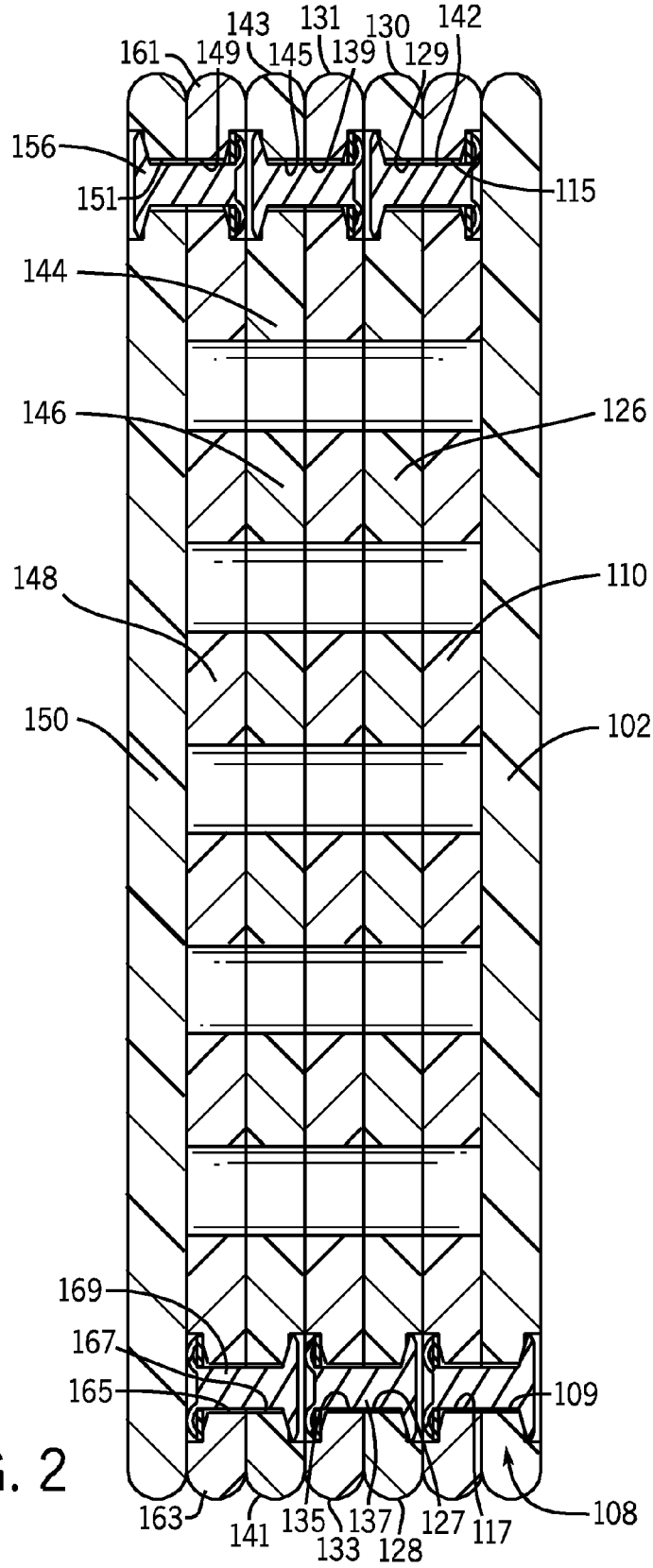
FIG. 2 is a cross-sectional view of the pivotally manipulable toy in a folded configuration.

A preferred embodiment according to one aspect of the present invention is illustrated in FIGS. 1-8. Referring now to FIGS. 1 and 2, there is illustrated a pivotally manipulable toy 100 that may be used for pivotally forming shapes. The pivotally manipulable toy 100 is formed with a series of sections. In the preferred embodiment these sections are preferably of identical length. In the preferred embodiment these sections are molded from plastic material; however, other materials including but not limited to wood, metal, or foam may instead be used. In one embodiment the pivotally manipulable toy 100 is comprised of seven sections. Other numbers of sections could instead be used.

A first solid end section 102 has a first end 104 and a second end 106 opposite the first end 104. There is an attachment aperture 109 (illustrated in FIG. 2) proximate to the second end 106 capable of receiving a metal rivet 108, in a preferred embodiment. In other embodiments other pivotal connection means including screws, plastic rivets, and other connection means are envisioned.

A first intermediate section 110 has a first end 112 and an opposite second end 114. Located in the first intermediate section 110 is an attachment aperture 115 (illustrated in FIG. 2) proximate to the first end 112 and an attachment aperture 117 (illustrated in FIG. 2) proximate to the second end 114. The attachment aperture 117 proximate to the second end 114 is capable of receiving metal rivet 108. The second end 114 of the first intermediate section 110 is placed on top of the second end 106 of the first solid end section 102 so that the attachment apertures 109 and 117 are in substantial alignment. A metal rivet 108 is inserted through the attachment apertures 109 and 117, operably pivotally coupling the first solid end section 102 to the first intermediate section 110.

In the preferred embodiment, the first intermediate section 110 comprises a plurality of counting apertures 116, 118, the annular recess 120, 122, and 124 that are approximately evenly spaced between the first end 112 and the second end 114. While in the embodiment shown in the figures the first intermediate section 110 comprises the five counting apertures 116, 118, 120, 122, and 124, other numbers of counting apertures could instead be used in other embodiments of the present invention.

A second intermediate section 126 in a preferred embodiment is substantially identical to first intermediate section 110. The second intermediate section 126 has a first end 128 and a second end 130 opposite the first end 128. In the preferred embodiment, the second intermediate section 126 also has five counting apertures 132, 134, 136, 138, and 140 as does the first intermediate section 110, with the counting apertures 132, 134, 136, 138, and 140 being spaced apart in substantially the same configuration as the counting apertures 116, 118, 120, 122, and 124 in the first intermediate section 110.

The second intermediate section 126 has an attachment aperture 129 (illustrated in FIG. 2) proximate the second end 130. The second end 130 is placed on top of the first end 112 of the first intermediate section 110, with the attachment apertures 115 and 129 in substantial alignment. A metal rivet 142 is inserted through these attachment apertures 115 and 129, operably pivotally coupling the first intermediate section 110 to the second intermediate section 126. The second intermediate section 126 also has an attachment aperture 127 proximate the first end 128.

A third intermediate section 144 in the preferred embodiment of the present invention is substantially identical to the first and second intermediate sections 110 and 126 with five spaced apart counting apertures located therein and has a first end 131 and a second end 133 opposite the first end 131. An attachment aperture 135 is defined in the second end 133. The second end 133 is placed on top of the first end 128 of the second intermediate section 126 such that the attachment aperture 127 and the attachment aperture 135 are in substantial alignment. The second intermediate section 126 and the third intermediate section 144 are operably pivotally coupled by inserting a metal rivet 137 through the attachment apertures 127 and 135. The third intermediate section 144 also defines an attachment aperture 139 proximate first end 131.

A fourth intermediate section 146 in the preferred embodiment of the present invention is substantially identical to the first, second and third intermediate sections 110, 126, and 144 with five spaced apart counting apertures located therein. The fourth intermediate section 146 includes a first end 141 and a second end 143 opposite the first end 141. The fourth intermediate section 146 has an attachment aperture 145 proximate the second end 143. The second end 143 of the fourth intermediate section 146 is placed on top of the first end 131 of the third intermediate section 144 such that the attachment apertures 145 and 139 are in substantial alignment. A metal rivet 147 is inserted into the attachment apertures 145 and 139 to pivotally couple the third intermediate section 144 to the fourth intermediate section 146. The fourth intermediate section 146 also has an attachment aperture 167 proximate the first end 141.

The fifth intermediate section 148 in the preferred embodiment of the present invention is substantially identical to the first, second, third, and fourth intermediate sections 110, 126, 144, and 146. The fifth intermediate section 148 has a first end 161 and a second end 163 opposite the first end 161. The fifth intermediate section 148 has an attachment aperture 165 proximate the second end 163. The fifth intermediate section 148 is placed on top of the fourth intermediate section 146 such that the attachment apertures 165 and 167 are in substantial alignment. A metal rivet 169 is inserted into the attachment apertures 165 and 167 pivotally coupling the fourth intermediate section 146 to the fifth intermediate section 148. The fifth intermediate section 148 also has an attachment aperture 149 proximate the first end 161.

A second solid end section 150 has a first end 152 and a second end 154 opposite the first end 152. The second solid end section 150 in the preferred embodiment of the present invention is substantially identical to the first solid end section 102. The second solid end section 150 has an attachment aperture 151 (illustrated in FIG. 2) proximate the second end 154 that is suitable for receiving a metal rivet 156. The second end 154 of the second solid end section 150 is placed on top of the fifth intermediate section 148 with the attachment aperture 151 in the second solid end section 150 substantially aligned with the attachment aperture 149 (illustrated in FIG. 2) defined in the fifth intermediate section 148 and the metal rivet 156 is inserted through these attachment apertures 149 and 151 to pivotally couple the second solid end section 150 to the fifth intermediate section 148.

This configuration of coupling each successive section on top of the previous section allows the pivotally manipulable toy to be folded into a compact, stacked configuration as illustrated in FIG. 2. FIG. 2 shows that the metal rivets connecting successive sections are at opposite ends of the sections. Also, each intermediate section 110, 126, 144, 146, and 148 is connected to exactly two other sections, while each solid end section 102, 150 is connected to exactly one intermediate section.

Figure 3:
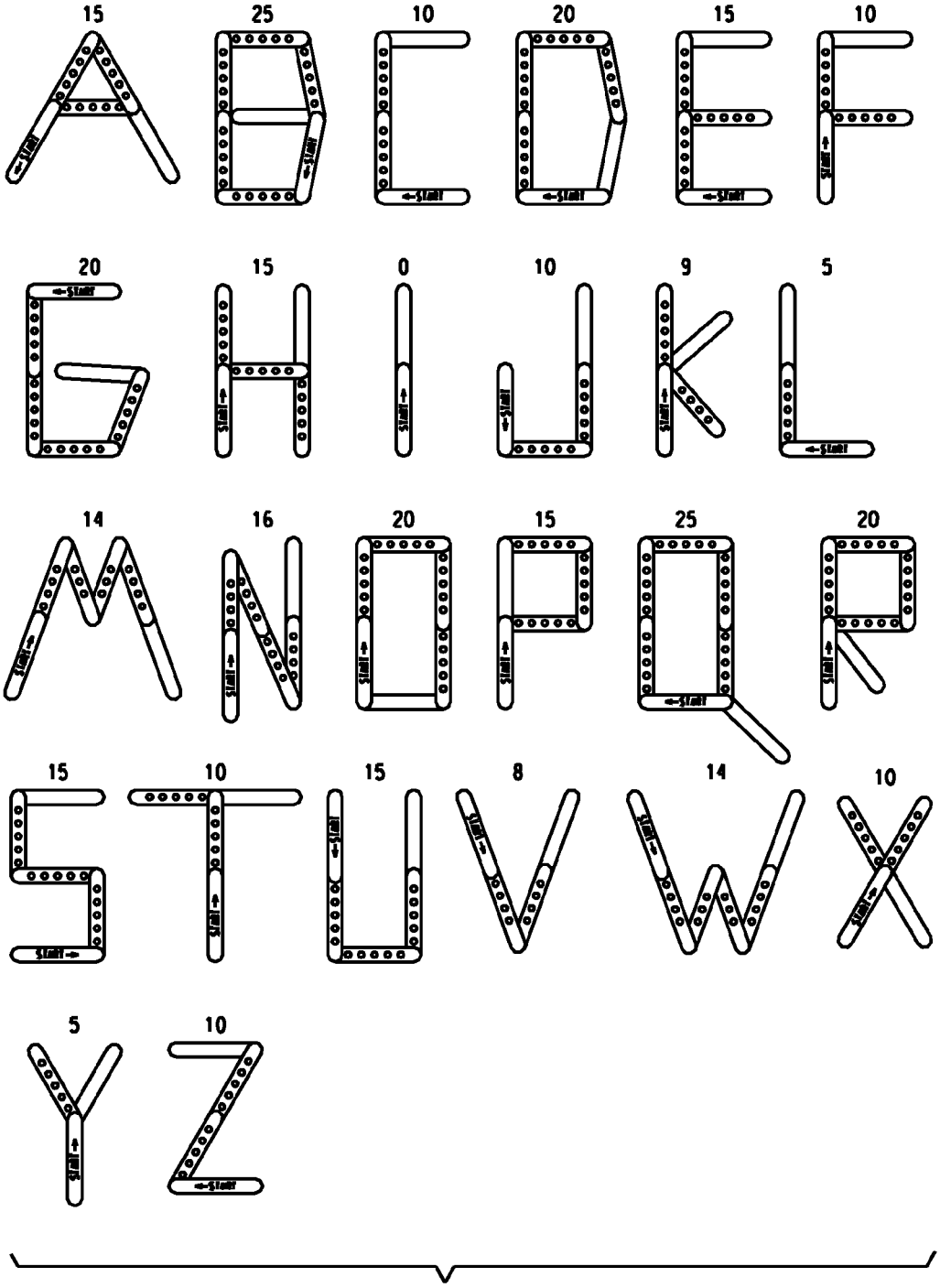
FIG. 3 is a plan view of a page from the pivotally manipulable toy manual illustrating the pivotally manipulable toy manipulated into each of the twenty-six letters of the alphabet, as well as the number of intermediate section apertures that should be unobstructed when the pivotally manipulable toy is pivotally manipulated to form a letter correctly.

FIG. 3 illustrates an exemplary page from a manual for the pivotally manipulable toy 100. This page illustrates how to make each of the twenty-six letters of the alphabet. As can be seen in FIG. 3, each of the letters has a number above it. This number represents the number of intermediate section counting apertures that should be unobstructed when the pivotally manipulable toy 100 is pivotally manipulated correctly to form each letter.

Figure 4:
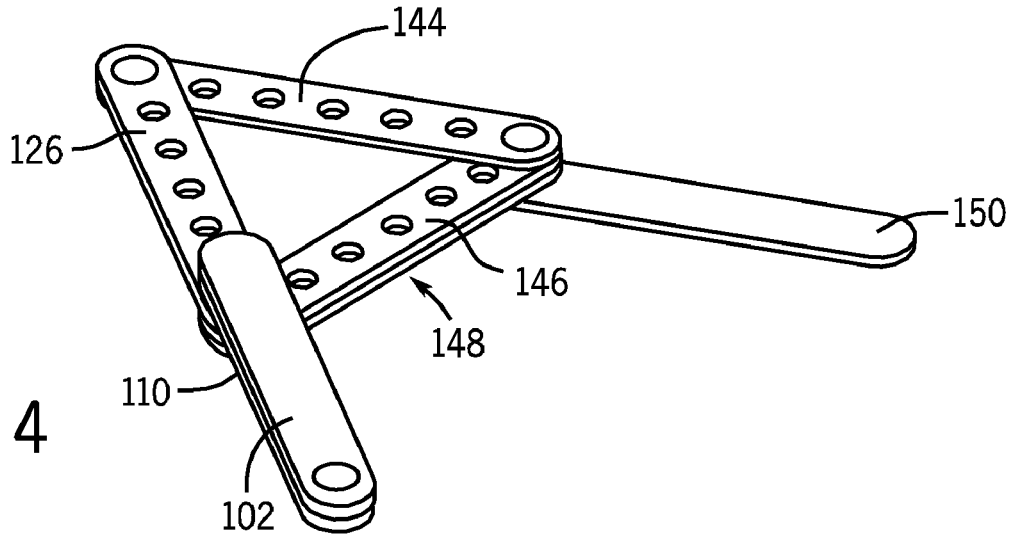
FIG. 4 is an isometric view of the pivotally manipulable toy in an "A" configuration.

FIG. 4 illustrates an embodiment of the pivotally manipulable toy pivotally manipulated to form an "A" letter. The first solid end section 102 is substantially overlapping the first intermediate section 110. The second intermediate section 126 is substantially in alignment with the first intermediate section 110. The third intermediate section 144 forms an angle with second intermediate section 126. The fourth intermediate section 146 forms an angle with the third intermediate section 144. The fifth intermediate section 148 substantially underlaps the fourth intermediate section 146. Finally, the second solid end section 150 is substantially aligned with the third intermediate section 144.

With respect to the number of unobstructed counting apertures, the first solid end section 102 has no counting apertures. The first intermediate section 110 is overlapped by the first solid end section 102, and therefore has no unobstructed counting apertures visible. The second intermediate section 126 is not overlapped and therefore has five unobstructed counting apertures visible. The third intermediate section 144 also is not overlapped, and therefore has five counting apertures visible. The fourth and fifth intermediate sections 146, 148 exactly overlap with the five counting apertures of these intermediate sections 146, 148 in substantial alignment, and therefore these two sections combine to reveal five more unobstructed visible counting apertures.

The total number of unobstructed counting apertures in this "A" letter configuration is, therefore, 15. Referring back to FIG. 3, the manual contains the number 15 above the illustration of the "A" letter to indicate that if the "A" letter is formed correctly the pivotally manipulable toy 100 should have 15 unobstructed counting apertures.

Figure 5:
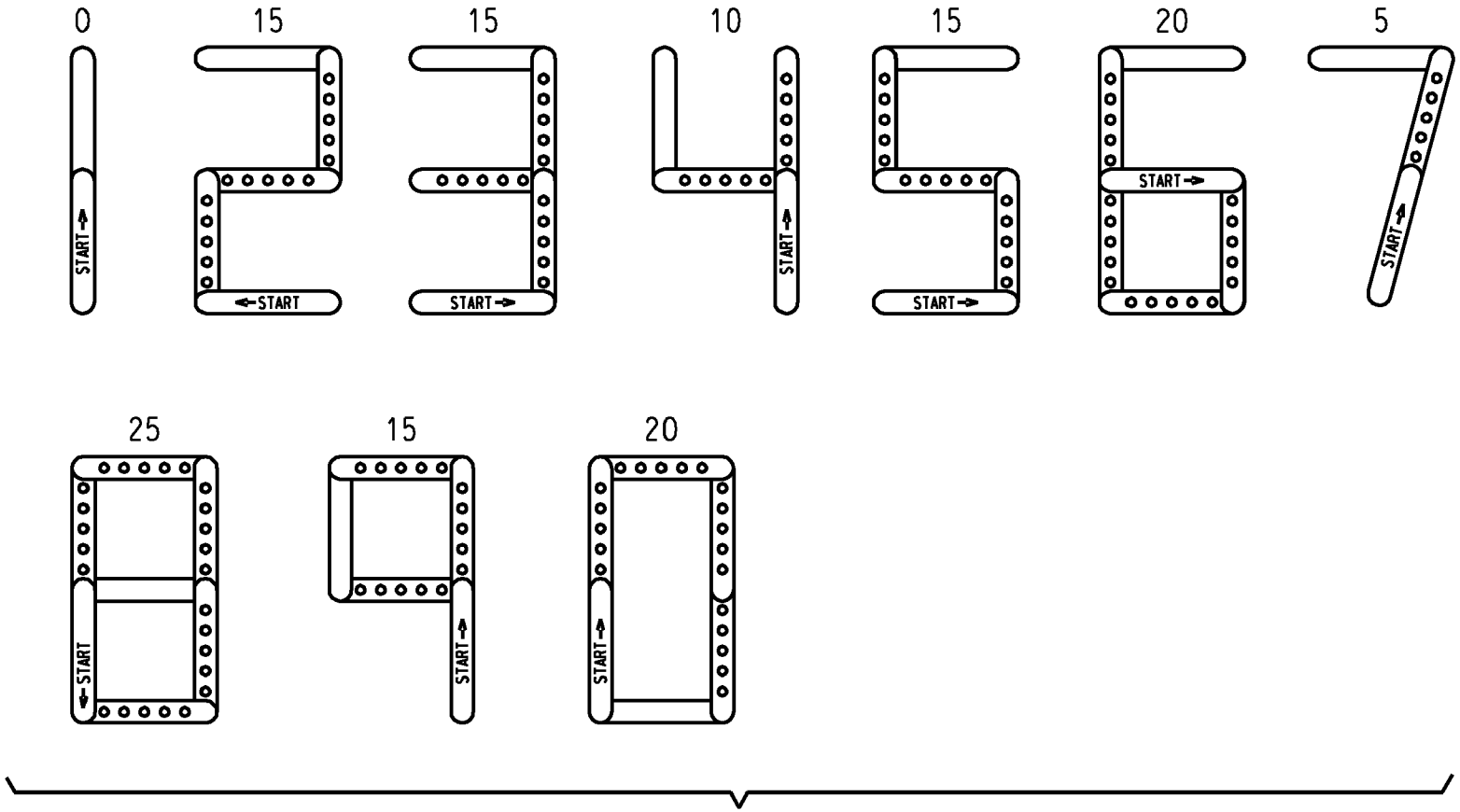
FIG. 5 is a plan view of a page from the pivotally manipulable toy manual illustrating the pivotally manipulable toy pivotally manipulated into each of the Arabic numerals, as well as the number of intermediate section apertures that should be unobstructed when the pivotally manipulable toy is pivotally manipulated to form each numeral correctly.

FIG. 5 illustrates a second exemplary page from a manual for the pivotally manipulable toy 100. This page illustrates how to make each of the Arabic numerals 0-9. As can be seen in FIG. 5, each of the illustrations of the numerals has a number above it representing the number of intermediate section apertures that should be unobstructed when the pivotally manipulable toy 100 is pivotally manipulated correctly to form each numeral.

Figure 6:
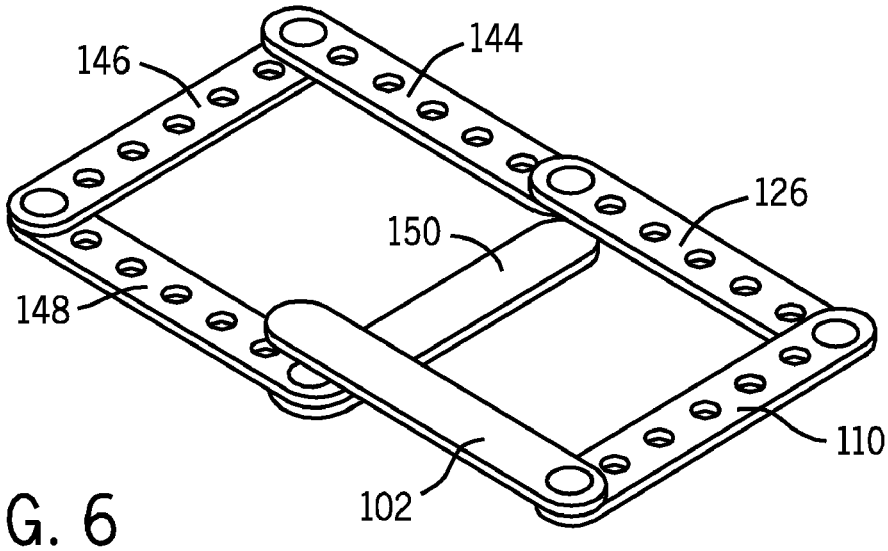
FIG. 6 is an isometric view of the pivotally manipulable toy in an "8" numeral configuration.

FIG. 6 illustrates an embodiment of the pivotally manipulable toy pivotally manipulated to form the numeral "8." The first solid end section 102 forms a ninety degree angle with the first intermediate section 110 and is substantially parallel to the second intermediate section 126. The second intermediate section 126 is substantially alighted with the third intermediate section 144. The third intermediate section 144 is substantially perpendicular to the fourth intermediate section 146. The fifth intermediate section 148 forms a substantially ninety degree angle with the fourth intermediate section 146. Finally the second solid end section 150 forms a ninety degree angle with the fifth intermediate section 148 and is substantially perpendicular to the first solid end section 102. Since none of the sections overlap, twenty-five counting apertures, the maximum number possible in this embodiment, are unobstructed when the pivotally manipulable toy is pivotally manipulated correctly to form the numeral "8." Referring back to FIG. 5, the manual illustrates the number 25 above the "8" numeral indicating that if the "8" numeral is formed correctly that 25 counting apertures will be unobstructed.

Figure 7:
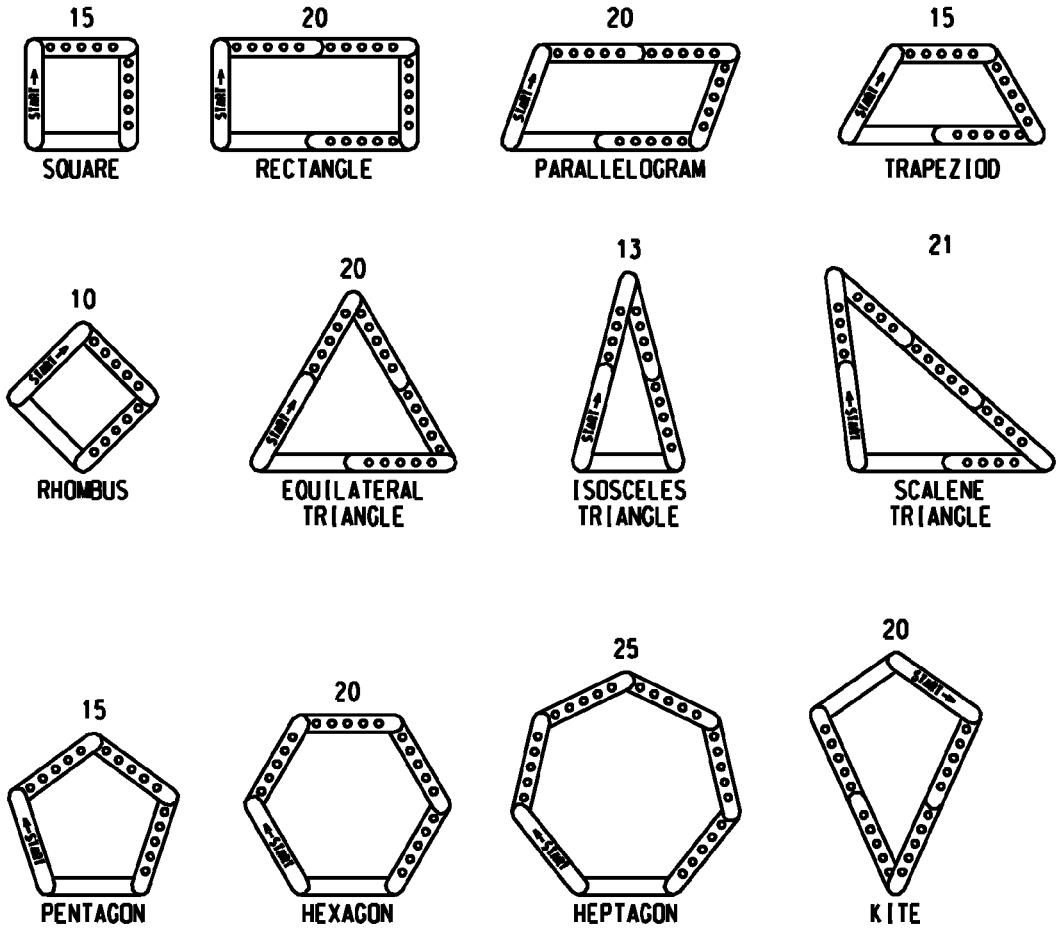
FIG. 7 is a plan view of a page from the pivotally manipulable toy manual illustrating the pivotally manipulable toy pivotally manipulated into a plurality of polygons, as well as the number of intermediate section apertures that should be unobstructed when the pivotally manipulable toy is pivotally manipulated to form a particular polygon correctly.

FIG. 7 illustrates a third exemplary page from a manual for the pivotally manipulable toy 100. This page illustrates how to form a plurality of polygons using an embodiment of the pivotally manipulable toy. As can be seen in FIG. 7, again, each of the illustrations of the polygons has a number above it representing the number of intermediate section counting apertures that should be unobstructed when the present embodiment of the pivotally manipulable toy 100 is pivotally manipulated correctly to form each polygon.

Figure 8:
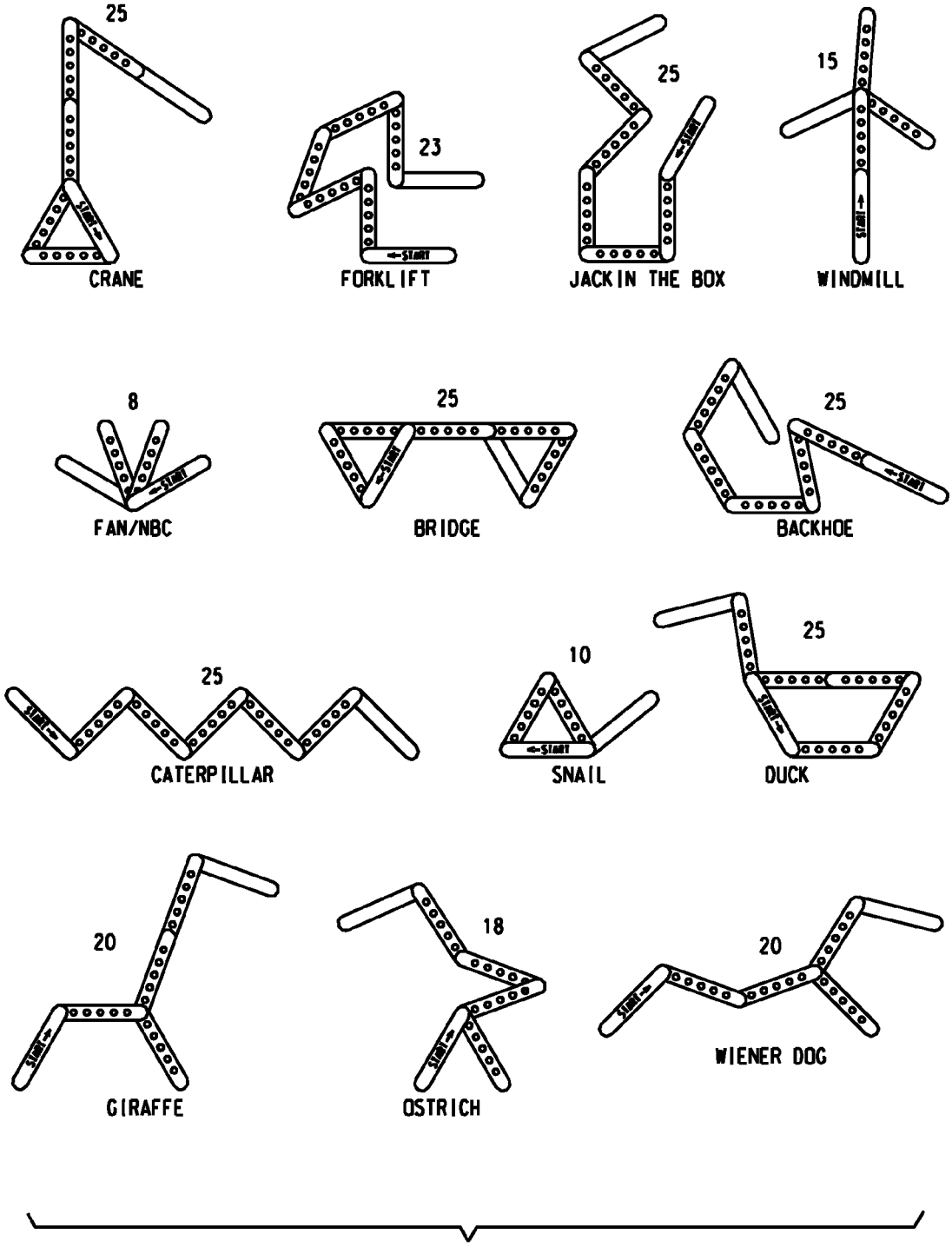
FIG. 8 is a plan illustration of a page from the pivotally manipulable toy manual illustrating the pivotally manipulable toy pivotally manipulated into a plurality of objects and animals, as well as the number of intermediate section apertures that should be unobstructed when the pivotally manipulable toy is pivotally manipulated to form a particular object or animal correctly.

FIG. 8 illustrates a fourth exemplary page from a manual for the pivotally manipulable toy 100. This page illustrates an embodiment of the pivotally manipulable toy manipulated to form a plurality of objects and animals. Again, each of the illustrations of the objects and animals has a number above it representing the number of intermediate section counting apertures that should be unobstructed when the present embodiment of the pivotally manipulable toy 100 is pivotally manipulated to form each object or animal. The objects and animals depicted are only an illustrative sample. Many other objects and animals are envisioned by the present application, as would be well-known to one skilled in the art of educational toy making.

Figure 9:
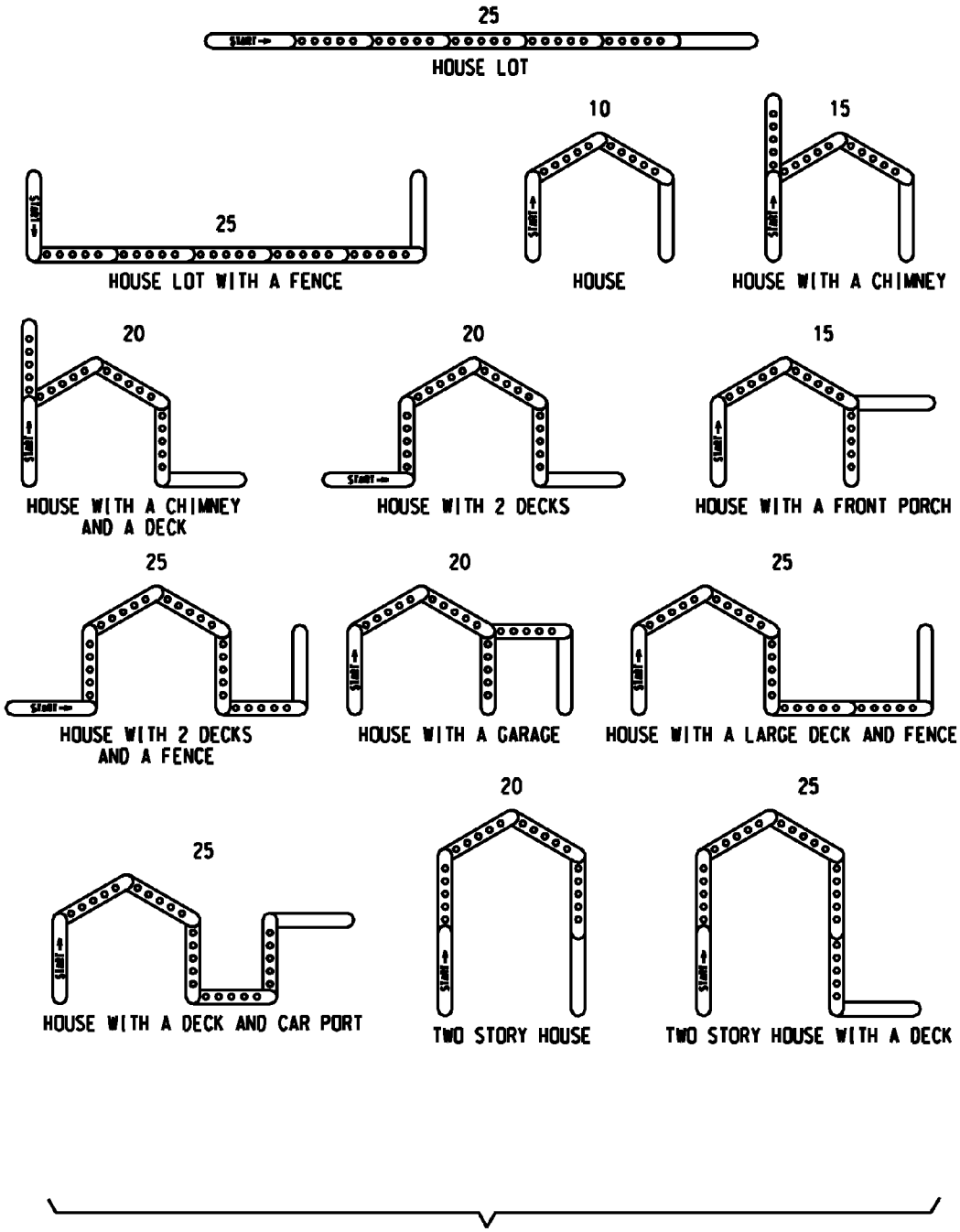
FIG. 9 is a plan illustration of a page from the pivotally manipulable toy manual illustrating the pivotally manipulable toy pivotally manipulated into a plurality of houses and house-related objects, as well as the number of intermediate section apertures that should be unobstructed when the pivotally manipulable toy is pivotally manipulated to form a particular house or house-related object correctly.

FIG. 9 illustrates a fifth exemplary page from a manual for the pivotally manipulable toy 100. This page illustrates an embodiment of the pivotally manipulable toy manipulated to form a plurality of houses and house-related objects. Again, each of the illustrations of the houses and house-related objects has a number above it representing the number of intermediate section counting apertures that should be unobstructed when the present embodiment of the pivotally manipulable toy 100 is pivotally manipulated to form each house or house-related object. The houses and house-related objects depicted are only an illustrative sample. Many other houses and house-related objects are envisioned by the present application, as would be well-known to one skilled in the art of educational toy making.

It may therefore be appreciated from the above detailed description of the exemplary embodiments of the present invention that it teaches a pivotally manipulable toy that is educational, fun, and easy enough for a child as young as approximately two years of age to manipulate. It does not have multiple separate pieces that could tend to easily be lost, and it has a verification system that enables a child using the toy to be certain as to whether or not the toy has been manipulated correctly to form a letter or numeral. The pivotally manipulable toy of the present invention is a toy that can be formed into many different shapes in addition to letters and numbers. It also may include a manual that illustrates the toy in many different configurations forming many different shapes correctly.

The pivotally manipulable toy of the present invention is of a construction which is both durable and long lasting, and it should also require little or no maintenance to be provided by the user throughout its operating lifetime. The pivotally manipulable toy of the present invention is also be of relatively inexpensive construction to enhance its market appeal and to thereby afford it the broadest possible market. Finally, the pivotally manipulable toy of the present invention achieves all of the aforesaid advantages and objectives without incurring any substantial relative disadvantage.

For purposes of this disclosure, the term "coupled" means the joining of two components directly or indirectly to one another. Such joining may be moveable in nature or stationary in nature. Such joining may be achieved with the two components and any additional intermediate members being integrally attached to one another or the two components and any additional member being formed as a single unitary body with one another. Such joining may be permanent in nature or alternatively be removable or releasable in nature.

Although the foregoing description of the pivotally manipulable toy and method of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the pivotally manipulable toy and method of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the pivotally manipulable toy and method of the present invention as determined by the appended claims when interpreted in accordance with the breadth to which they are fairly, legally, and equitably entitled.

What is claimed is:

1. A method of operating a pivotally manipulable toy, the method comprising:

viewing a manual that provides a plurality of shapes that can be formed by pivotally manipulating a multi-segment pivotally manipulable member comprising a first end section, a plurality of intermediate sections, and a second end section; wherein the first end section, the plurality of intermediate sections and the second end section are pivotally coupled together in a series beginning with the first end section pivotally coupled to a first one of the plurality of intermediate sections and ending with a last one of the plurality of intermediate sections pivotally coupled to the second end section; wherein each section in the plurality of intermediate sections has a plurality of spaced-apart counting apertures located therein; wherein the manual also provides a separate corresponding counting aperture indicator for each of the shapes in the plurality; wherein each counting aperture indicator represents a total number of counting apertures that are substantially unobstructed when one of a corresponding shape in the plurality is formed; and manipulating the manipulable member so as to form a selected shape in the plurality of shapes;

verifying that the selected shape is correctly formed by identifying the selected shape in the plurality of shapes provided in the manual and its corresponding counting aperture indicator and then verifying that the manipulable member has a shape substantially the same as the selected shape and a same total number of counting apertures that are substantially unobstructed as the corresponding counting aperture indicator.

2. The method of claim 1, comprising correctly forming each shape in the plurality of shapes by placing the manipulable member on a corresponding shape in the plurality of shapes provided in the manual, identifying counting apertures that are substantially unobstructed as depicted in the corresponding shape, and aligning the counting apertures of the manipulable member with the counting apertures that are substantially unobstructed as depicted in the corresponding shape.

3. The method of claim 1, wherein the plurality of shapes comprises letters.

4. The method of claim 1, wherein the plurality of shapes comprises numerals.

5. The method of claim 1, wherein the counting aperture indicators comprise numerals.

6. The method of claim 4, wherein the numerals are Arabic.

7. The method of claim 1, wherein each section in the plurality of intermediate sections comprises five counting apertures located therein.

8. The method of claim 6, wherein the plurality of intermediate sections consists of five intermediate sections.

9. The method of claim 7, wherein the plurality of intermediate sections has exactly twenty-five counting apertures.

* * * * *